US006314843B1

(12) United States Patent
Wiebe et al.

(10) Patent No.: US 6,314,843 B1
(45) Date of Patent: Nov. 13, 2001

(54) PARALLEL PLIERS

(75) Inventors: Ulrich Wiebe, Dürentrop; Armin Ulbrich, Detmold; Helmut Thiele, Kamen, all of (DE)

(73) Assignee: Weidmüller Interface GmbH & Co., Detmold (DE)

( * ) Notice: Subject to any disclaimer, the term of this patent is extended or adjusted under 35 U.S.C. 154(b) by 0 days.

(21) Appl. No.: 09/524,562

(22) Filed: Mar. 13, 2000

(30) Foreign Application Priority Data

May 26, 1999 (DE) ..... 199 23 998

(51) Int. Cl.[7] ..... B25B 7/12
(52) U.S. Cl. ..... 81/355; 81/356
(58) Field of Search ..... 81/355, 356, 363, 81/385, 386

(56) References Cited

U.S. PATENT DOCUMENTS

| | | | | |
|---|---|---|---|---|
| 1,380,044 | * | 5/1921 | Davis | 81/356 |
| 2,481,435 | * | 9/1949 | Meunier | 81/356 |
| 2,731,867 | | 1/1956 | Daugherty . | |
| 2,844,061 | * | 7/1958 | Hendrickson | 81/385 |
| 3,029,670 | | 4/1962 | Over et al. . | |
| 4,274,312 | * | 6/1981 | Finn | 81/356 |
| 4,802,390 | * | 2/1989 | Warheit | 81/341 |
| 4,884,479 | * | 12/1989 | Mazzone | 81/128 |
| 5,094,132 | * | 3/1992 | Engel | 81/363 |
| 5,385,072 | * | 1/1995 | Neff | 81/405 |
| 6,026,671 | * | 2/2000 | Battenfeld | 72/409.12 |
| 6,065,376 | * | 5/2000 | Khachatoorian | 81/407 |
| 6,116,124 | * | 9/2000 | Ping | 81/385 |

FOREIGN PATENT DOCUMENTS

| | | |
|---|---|---|
| 2404161 | 1/1974 | (DE) . |
| 2338309 | 2/1975 | (DE) . |
| C2-2903252 | 9/1980 | (DE) . |
| 0087630 A2 | 9/1983 | (EP) . |
| A2087630 | 9/1983 | (EP) . |
| 0868978 A1 | 10/1998 | (EP) . |

* cited by examiner

*Primary Examiner*—James G. Smith
*Assistant Examiner*—Hadi Shakeri
(74) *Attorney, Agent, or Firm*—Birch, Stewart, Kolasch & Birch, LLP

(57) ABSTRACT

Pliers contain two parallel operating jaws (3, 7) and two handles (1, 16) which can be pivoted relative to one another and one of which (1), in order to form a first plier unit (Z1 ), is connected fixedly to a first (3) of the operating jaws and another (16), in order to form a second plier unit (Z2), is connected in an articulated manner to a second (7) of the operating jaws, via a drive device (14), in order, during pivoting of the handles (1, 16), for the operating jaws (3, 7) to be moved towards one another or away from one another in an operating direction (A). It is possible to preset a rest position of the second plier unit (Z2) relative to the first plier unit (Z1 ) in the operating direction (A).

13 Claims, 7 Drawing Sheets

PARALLEL PLIERS

FIELD OF THE INVENTION

The present invention relates to pliers.

DESCRIPTION OF THE BACKGROUND ART

Pliers having two operating jaws which are parallel in each position of their pivotable handles are known in general. The object of the invention is to provide parallel pliers with improved possibilities for use.

SUMMARY OF THE INVENTION

Pliers according to the invention contain two parallel operating jaws and two handles which can be pivoted relative to one another and of which one, in order to form a first plier unit, is connected fixedly to a first of the operating jaws and another, in order to form a second plier unit, is connected in an articulated manner to a second of the operating jaws, via a drive device, in order, during pivoting of the handles, for the operating jaws to be moved towards one another or away from one another in an operating direction, it being possible to preset a rest position of the second plier unit relative to the first plier unit in the operating direction.

By virtue of this capacity for presetting the rest position of the second plier unit relative to the first plier unit, the possibilities for using the parallel pliers according to the invention may be extended since there is now greater scope for using them to work on articles of different widths. In order to set the rest position of the second plier unit relative to the first plier unit, all that is required is for the two plier units to be displaced relative to one another, which can take place with the aid of suitable actuating means which are connected to the pliers. In this case, the relative displacement between the two plier units takes place in the operating direction, that is to say in the direction in which the mutually parallel operating jaws are also moved towards one another or away from one another.

According to an advantageous configuration of the invention, the second operating jaw is seated on a carriage which can be displaced with sliding action on a rail connected to the first operating jaw. This ensures, on the one hand, good parallel displacement of the operating jaws with respect to one another and, on the other hand, also good relative displacement between the two plier units in the operating direction.

In a further configuration of the invention, the drive device is also guided along the rail, this achieving a straightforward and functionally reliable plier construction.

It is possible to use, as the drive device, for example at least one toggle lever in order, during pivoting of the handles, to achieve the necessary pressing force in the plier mouth between the operating jaws. Instead of the at least one toggle lever, however, it is also possible to use other drive devices, if appropriate in combination with a toggle lever, for example a pneumatic or an electric drive device.

When using a drive device designed as a toggle lever, it is possible for an articulation pin of the toggle lever to be guided in a longitudinal slit of the rail, on which the first operating jaw is seated, said slit extending in the operating direction. This ensures reliable parallel guidance of the drive device in the operating direction and thus corresponding movement of the second plier unit relative to the first plier unit.

In this case, the articulation pin guided in the longitudinal slit may be that which is located nearest the handle which is connected to the drive device.

Provided in order to displace the plier units relative to one another in the operating direction are actuating means, with the aid of which the toggle-lever articulation pin guided in the longitudinal slit can be displaced. The actuating means comprise a threaded rod which is mounted merely rotatably in the longitudinal slit and extends in the operating direction, and guided on said threaded rod is a bearing block which is provided with a corresponding internal thread, is secured against rotation in the longitudinal slit and serves for forming the articulation pin. For this purpose, there may be journals on opposite sides of the bearing block.

By virtue of the threaded rod being rotated, the bearing block may be displaced in the longitudinal direction of the same and thus in the operating direction, which results in the entire toggle lever, the second operating jaw and the plier handle connected to the drive device being carried along correspondingly, that is to say in the second plier unit being displaced relative to the first plier unit. The actuating means thus have a relatively straightforward construction.

In this case, an articulation pin of the toggle lever which is located nearest the second operating jaw is connected to the carriage, which bears the second operating jaw, which further simplifies the overall construction of the pliers.

According to an additional development of the pliers according to the invention, a central articulation pin of the toggle lever bears an eccentric which is connected fixedly to an actuating lever, engages in a lateral groove with a closed end side, said groove being introduced in the carriage, and can be guided against said end side. A corresponding rotary position of the eccentric as a result of the actuation of the actuating lever can achieve the situation where, upon closure of the handles of the pliers or upon closure of the plier mouth, the toggle lever either is blocked at a position in which the toggle lever is not yet fully straightened out or is blocked at a position at which the toggle lever has passed the straightened-out position. In the first-mentioned case, the plier mouth can open of its own accord again when the handles are relieved of loading, whereas, in the last-mentioned case, the toggle lever has to be actuated directly by hand in order to be guided out of the blocking position. This can take place, for example, by suitable rotation of the actuating lever, which is connected to the eccentric.

According to a further configuration of the invention, those ends of the carriage and rail which are oriented towards the front plier ends in each case may have retaining means for the releasable fastening of further tool parts. Since the carriage and rail are displaced relative to one another when the plier handles are actuated, it is also possible for the tool parts, which are connected to the carriage and rail at their respective free ends, to be displaced relative to one another, and as a result of which it is possible to actuate an additional arrangement which is connected to the pliers. This additional arrangement may be, for example, a riveting device for blind rivets. It is formed, for example, from a cylindrical clamping arrangement which is retained on the rail and is intended for receiving a rivet pin in a clamping manner and from a supporting arrangement which encloses the clamping arrangement in a sleeve-like manner, is fastened at the front end of the carriage and can be moved beyond the free end of the clamping arrangement.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

An exemplary embodiment of the pliers according to the invention is explained in more detail hereinbelow with reference to the drawings which are given by way of illustration only, and thus are not limitative of the present invention, and, in which.

DETAILED DESCRIPTION OF THE PREFERRED EMBODIMENTS

The construction of the parallel pliers according to the invention will be explained hereinbelow first of all with reference to FIGS. 1 and 2.

Figure 1:
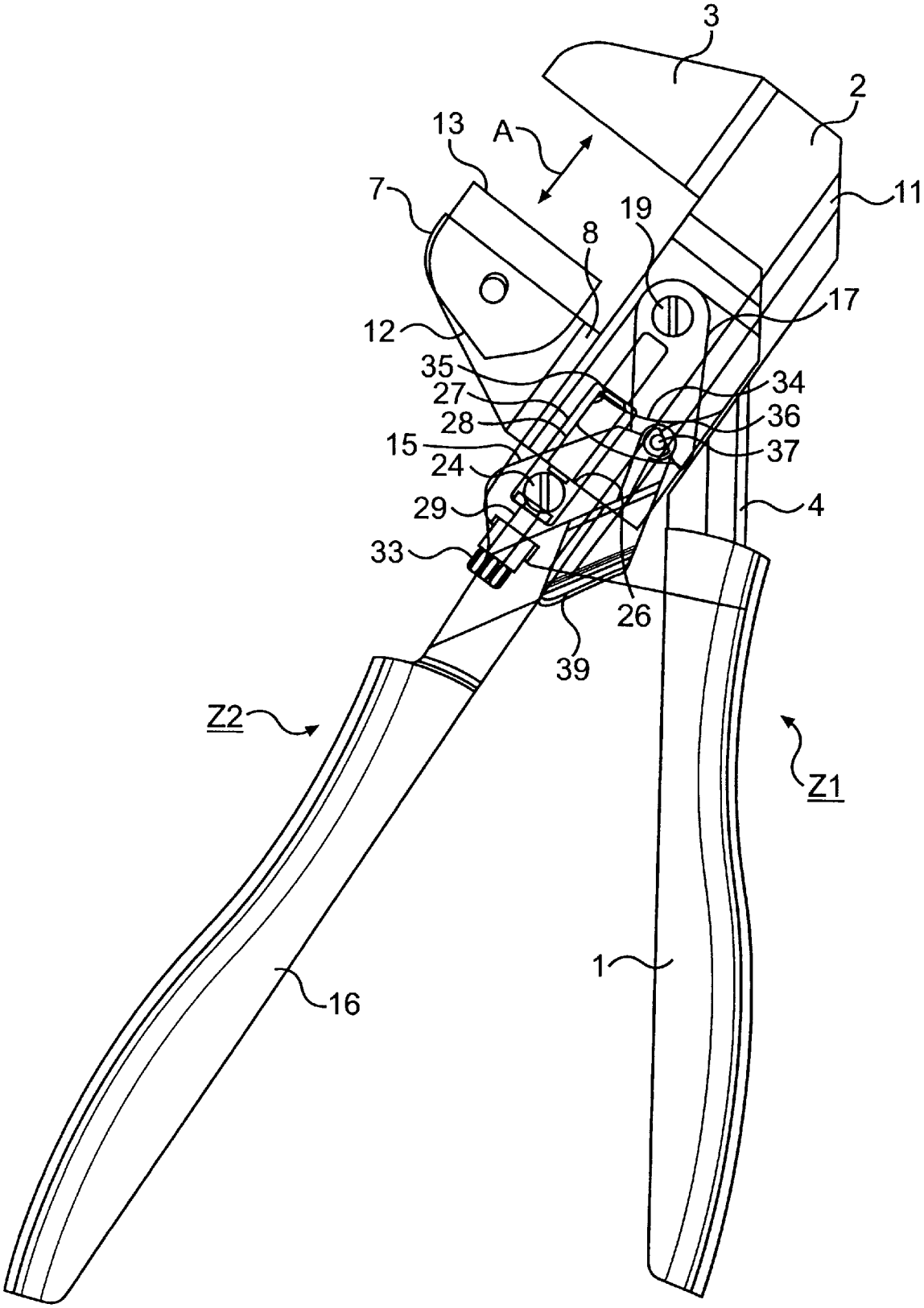
FIG. 1 shows the open pliers in a first rest position.
Figure 2:
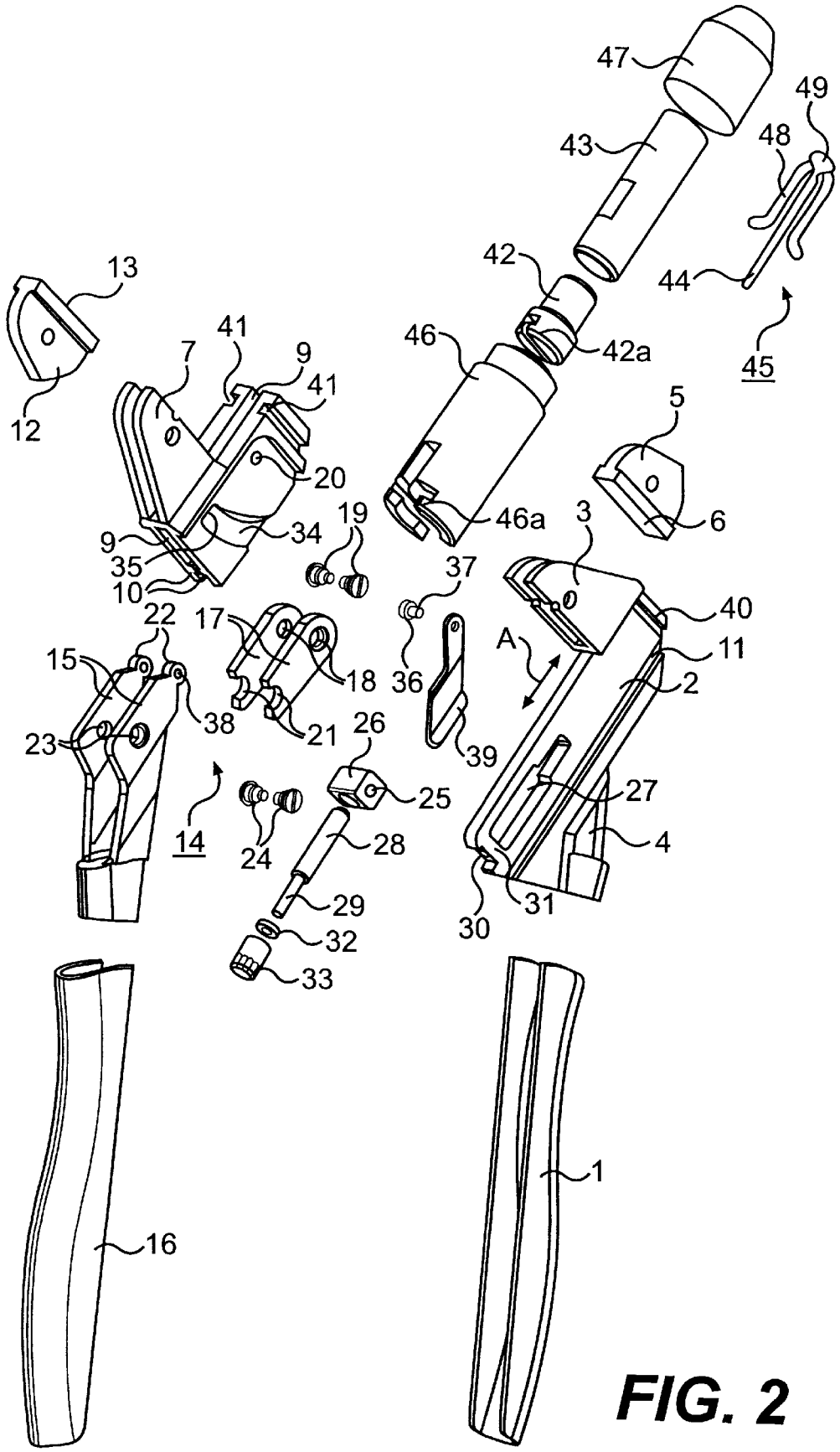
FIG. 2 shows an exploded illustration of the pliers.

According to FIGS. 1 and 2, the parallel pliers contain a first handle 1 which is connected fixedly to a guide rail 2 on which a first operating jaw 3 is arranged in a fixed manner. The guide rail 2 is designed as a flat rail, on the bottom longitudinal side of which the first handle 1 is fastened via an obliquely downwardly projecting flange 4. The first operating jaw 3 is located on the opposite longitudinal side of the guide rail 2 and at that end of the latter which is directed away from the first handle 1. The first operating jaw is of U-shaped design and has its surface which is oriented away from the front plier end located perpendicularly to the guide rail 2. A tool part 5 can be inserted between the legs of the U-shaped first operating jaw 3 such that the operating surface 6 of said tool part is oriented away from the front plier end. The guide rail 2 itself runs slightly obliquely to the longitudinal direction of the first handle 1.

A second operating jaw 7 is seated fixedly on a carriage 8 which, for its part, has a slit 9 which runs in its longitudinal direction and serves for receiving the guide rail 2. At the base-side end of the carriage 8, webs 10 project inwardly into the slit 9, although they do not come into contact with the same. These webs 10 engage in longitudinal grooves 11, which are located on opposite sides of the guide rail 2, and thus ensure that the carriage 8 is secured on the guide rail 2. In this case, the carriage 8, and with it the second operating jaw 7, can be displaced in the longitudinal direction of the guide rail 2, that is to say in the operating direction. The second operating jaw 7 has its surface which is oriented towards the first operating jaw 3 located perpendicularly to the guide rail 2, with the result that the two mutually facing surfaces of the operating jaws 3 and 7 run parallel to one another. The carriage 8 can be pushed onto the guide rail 2 from that end side of the latter which is located opposite the first operating jaw 3. This also applies to the case where the first handle 1 is fastened on the flange 4.

The second operating jaw 7 is also of U-shaped design and receives between its legs a tool part 12, of which the operating surface 13 is oriented towards the first operating jaw 3 and comes to rest parallel to the operating surface 6 of the tool part 5. The tool parts 5, 12 may be replaced by any other desired tool part.

In order to drive the carriage 8 along the guide rail 2, use is made of a toggle lever 14, which may also be referred to as a drive device. The toggle lever 14 is constructed from parallel members or levers which receive the carriage 8 between them.

In specific terms, the toggle lever 14 comprises two parallel first members 15 which are connected fixedly to a second handle 16 of the pliers by way of their end which is oriented away from the plier mouth. The toggle lever 14 also comprises two second members 17 which are located parallel to one another and are articulated on different sides of the carriage 8 in each case by way of their end which is oriented towards the plier mouth. For this purpose, the second members 17 have, at their ends which are located towards the plier mouth, threaded openings 18 into which there are screwed screws 19 which engage in blind-hole openings 20 which are located in opposite sides of the carriage 8. For the articulated connection of the first members 15 to the second members 17, the latter have recesses 21 in the direction of the first members 15, extensions 22 of the first members 15 being received pivotably in said recesses. The recesses 21 thus form, together with the extensions 22, a central toggle-lever articulation. At those ends of the first members 15 which are oriented towards the second handle 16, said first members have threaded through-passage bores 23 into which there are screwed from the outside screws 24 which engage, by way of their free and non-threaded ends, in mutually opposite blind-hole bores 25 of a cuboidal bearing block 26 which is located between the first members 15. The bearing block 26 can thus be pivoted about the ends of the screws 24, which form a bottom bearing pin of the toggle lever 14. The top bearing pin of the toggle lever 14 is formed correspondingly by the screws 19, which are designed in the same way as the screws 24.

The bearing block 26 itself is guided within a longitudinal slit 27 which is located in the guide rail 2 and extends in the operating direction A, which is located parallel to the longitudinal direction of the guide rail 2. In this case, the bearing block 26 may merely slide, and not rotate, in the longitudinal slit 27. Positioned within the longitudinal slit 27 is a threaded rod 28 which extends likewise in the operating direction A. This threaded rod 28 is suitably fixed longitudinally within the longitudinal slit 27, that is to say it cannot be displaced in the operating direction A. It is able merely to rotate about its longitudinal axis. The bearing block 26 is seated on the threaded rod 28, the threaded rod 28 running through an inner bore, provided with a mating thread, of the bearing block 26. If the threaded rod 28 is rotated about its longitudinal axis, the bearing block 26 is displaced in the longitudinal direction of the longitudinal slit 27 in one direction or the other, depending on the direction of rotation of the threaded rod 28. At its end which is oriented away from the plier mouth, the threaded rod 28 has a non-threaded section 29 which projects through a bore 30 which is located in a web 31 at the bottom end of the longitudinal slit 27. The threaded rod 28 is secured against dropping out of the longitudinal slit 27 by means of a securing ring 32, and an actuating wheel 33, via which the threaded rod 28 can be rotated, is positioned fixedly at the free end of the section 29.

As can further be seen, a groove 34 is located on an outer side of the carriage 8, said groove extending from the base of the carriage 8 and running as far as a top end wall 35, which closes the groove 34. In this case, the groove 34 is of convex design relative to the blind-hole opening 20. Engaging in the groove 34 is an eccentric 36 which is designed in the form of a disc with a flattened circumferential part. Fastened on one side of the eccentric or of the disc 36 is a pin 37 which bears the latter and projects through an opening 38 which is located in the extension 22 of the right-hand lever-arm member 15 shown in FIG. 2. The eccentric 36 thus comes to rest between the members 15 and is mounted in the opening 38 via the pin 37. The free end of the pin 37 is connected fixedly to an actuating lever 39, with the result that the eccentric 36 can be rotated via the actuating lever 39. Depending on whether the eccentric disc 36 itself, or its flattened circumferential section, strikes against the end wall 35 of the groove 34, the toggle lever 14 is not straightened out or goes beyond the straightened-out position of 180°, with the result that, accordingly, it assumes either its non-blocking position or its blocking position. In the last-mentioned case, the pliers have a self-retaining function, which can be terminated in that the lever 39 is rotated again such that the central articulation pin of the toggle lever 14 is removed again from the end wall 35.

Further additional tools may be connected to the pliers according to the invention, to be precise in each case via the free ends of the carriage 8 and guide rail 2. For this purpose, the carriage 8 and the guide rail 2 have, at the front plier end, retaining grooves 40 and 41 onto which tool elements can be pushed. The retaining grooves 40, 41 run perpendicularly to the operating direction A.

It is thus possible to push onto the free end of the guide rail 2 a carrier element 42 which engages round the guide rail 2 and engages in the retaining grooves 40 by way of extensions 42*a*. The carrier element 42 serves for securing a clamping arrangement 43 for the pin 44 of a blind rivet 45. Arranged in the clamping arrangement 43 are clamping jaws (not illustrated) which fixedly clamp and retain the pin 44 when the clamping arrangement 43 is to be drawn off from the pin 44 again. This is known in general in conjunction with blind-riveting devices and will not explained here in any more detail.

It is also possible for a supporting arrangement 46 to be pushed onto the front end side of the carriage 8. The supporting arrangement 46 likewise engages round the front end of the carriage 8 and projects into the grooves 41 by way of extensions 46*a*. A pressing element 47 is located at the front end of the supporting arrangement 46, the supporting arrangement 46 and pressing element 47 enclosing the carrier element 42 and the clamping arrangement 43 in a sleeve-like manner. Upon closure of the plier mouth, the front end of the pressing element 47 presses against the bottom border of a collar 48 of the blind rivet 45, while, on the other hand, the rivet pin 44 is secured by the clamping arrangement 43. This results, finally, in a riveting operation in which the pin 44 separates off from the head 49 of the blind rivet 45 once the head 49 has correspondingly deformed the top border of the collar 48.

The functioning of the pliers according to the invention will be explained in more detail hereinbelow.

First of all, please refer back to FIGS. 1 and 2. In FIG. 1, the pliers are located in the open state with the handles 1 and 16 spread apart from one another. The toggle lever 14, which comprises the members 15 and 17, is not straightened out and the operating jaws 3 and 7 are located at a distance from one another. The plier mouth is open.

According to FIG. 1, the first handle 1 and first operating jaw 3, which is connected fixedly to the first handle via the guide rail 2, form a first plier unit Z1. On the other hand, the second handle 16, the second operating jaw 7, which is seated on the carriage 8, and the toggle lever 14 form a second plier unit Z2. The two plier units Z1, Z2 can be displaced relative to one another and are located in a first position relative to one another in FIG. 1.

Figure 3:
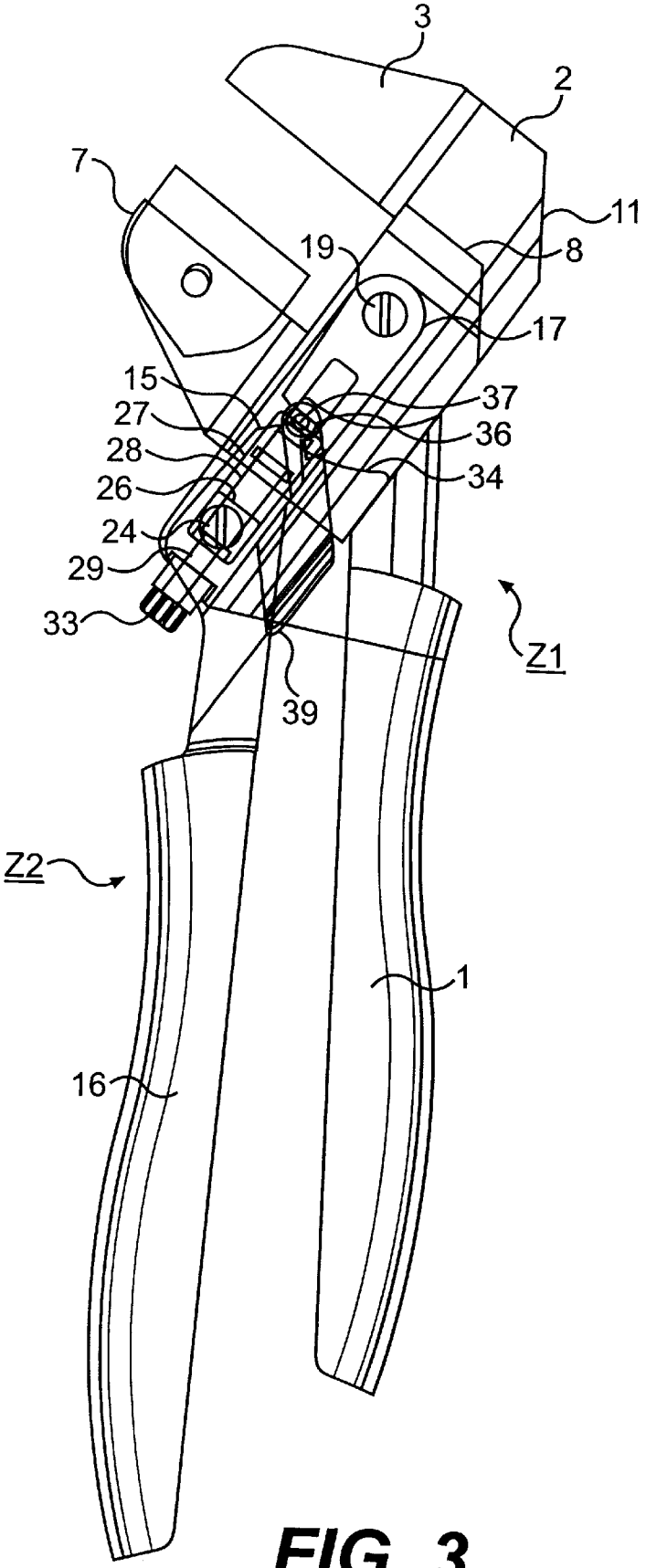
FIG. 3 shows the closed pliers in the first rest position.

If the pliers in FIG. 1, starting from their open position, are transferred into their closed position in FIG. 3 by virtue of the handles 1 and 16 being moved towards one another, then, assuming the handle 1 is fixed, the second handle 16 rotates in the counter clockwise direction about the pin formed by the screws 24. The same applies to the first toggle-lever member 15. Since the bearing block 26 does not change its relative position in the longitudinal slit 27, there is no change either in the position of the bearing pin 24 relative to the first plier unit Z1, which results in the second member 17 of the toggle lever rotating in the clockwise direction about the toggle-lever pin formed by the screws 19, said toggle-lever pin being displaced at the same time in the direction of the first operating jaw 3 and carrying along the carriage 8 in the process since the free ends of the screws 19 engage in the blind-hole bore 20 of the carriage 8. The second operating jaw 7 is then moved in the direction of the first operating jaw 3 by way of the carriage 8.

During this closing operation of the pliers, the movement of the members 15 and 17 means that the eccentric 36 in the groove 34 runs to the top left in FIG. 1 and FIG. 3 and then strikes against the end wall 35, which closes the groove 34.

If the actuating lever 39 is located in the position shown in FIGS. 1 and 3, then there is still sufficient material of the eccentric 36 between the pin 37 and end wall 35, as a result of which the toggle lever 14 is prevented from being forced through beyond an angle of 180°. Once the handles 1 and 16 have been relieved of loading, the pliers can thus pass into the open state again of their own accord, which is possible by virtue of suitable restoring springs, which, for the sake of clarity, are not illustrated here.

Figure 4:
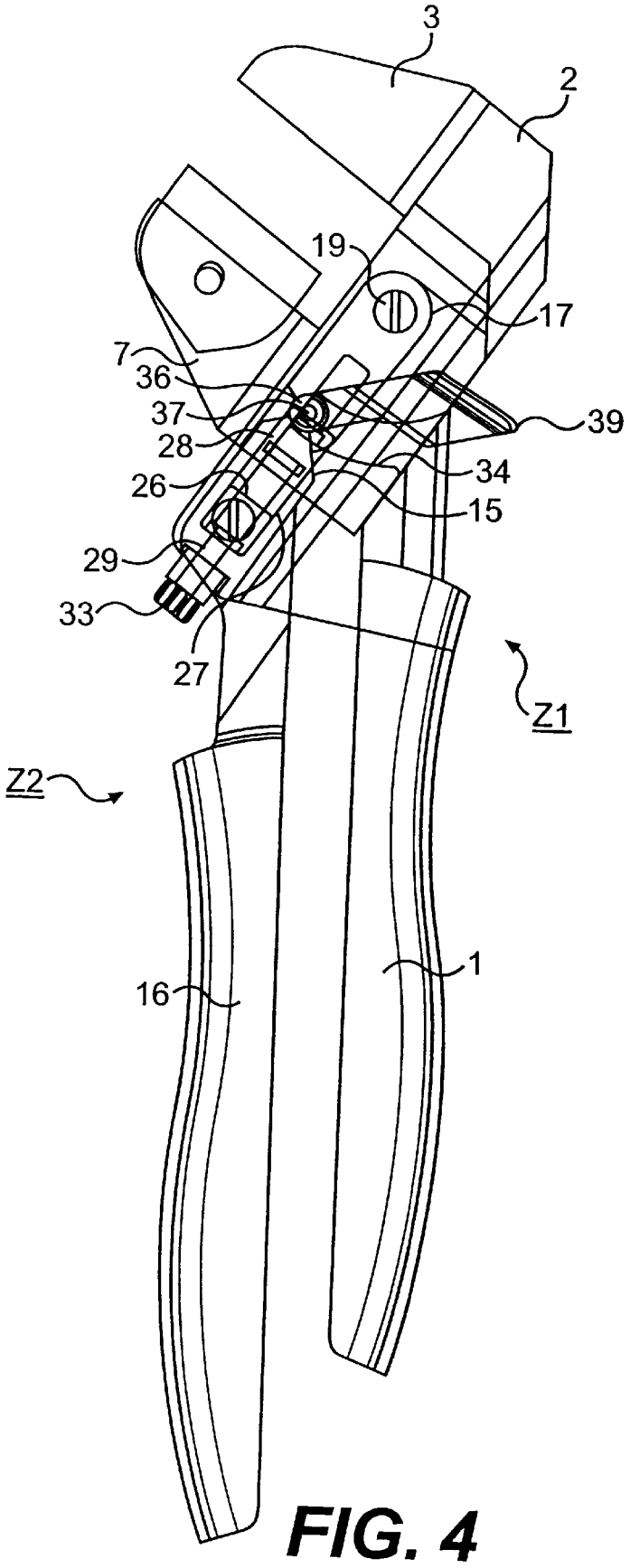
FIG. 4 shows the closed pliers in the first rest position with the eccentric rotated.

FIG. 4, however, shows the situation where the actuating lever 39 is rotated such that the flattened circumferential section of the eccentric disc 36 is located opposite the end wall 35. In this case, the toggle lever can be forced through more than 180° with the pliers closed, with the result that a self-retaining function of the pliers is then realised. An article clamped in the plier mouth thus remains clamped in even when the handles 1 and 16 are relieved of loading. It is only when the actuating lever 39 is rotated in the clockwise direction about the central articulation pin 37 that the self-retaining function can be terminated, since the eccentric disc 36 then strikes against the end wall 35 of the groove 34 again by way of its larger diameter and thus forces the toggle lever 14 through in the direction of the starting position.

Figure 5:
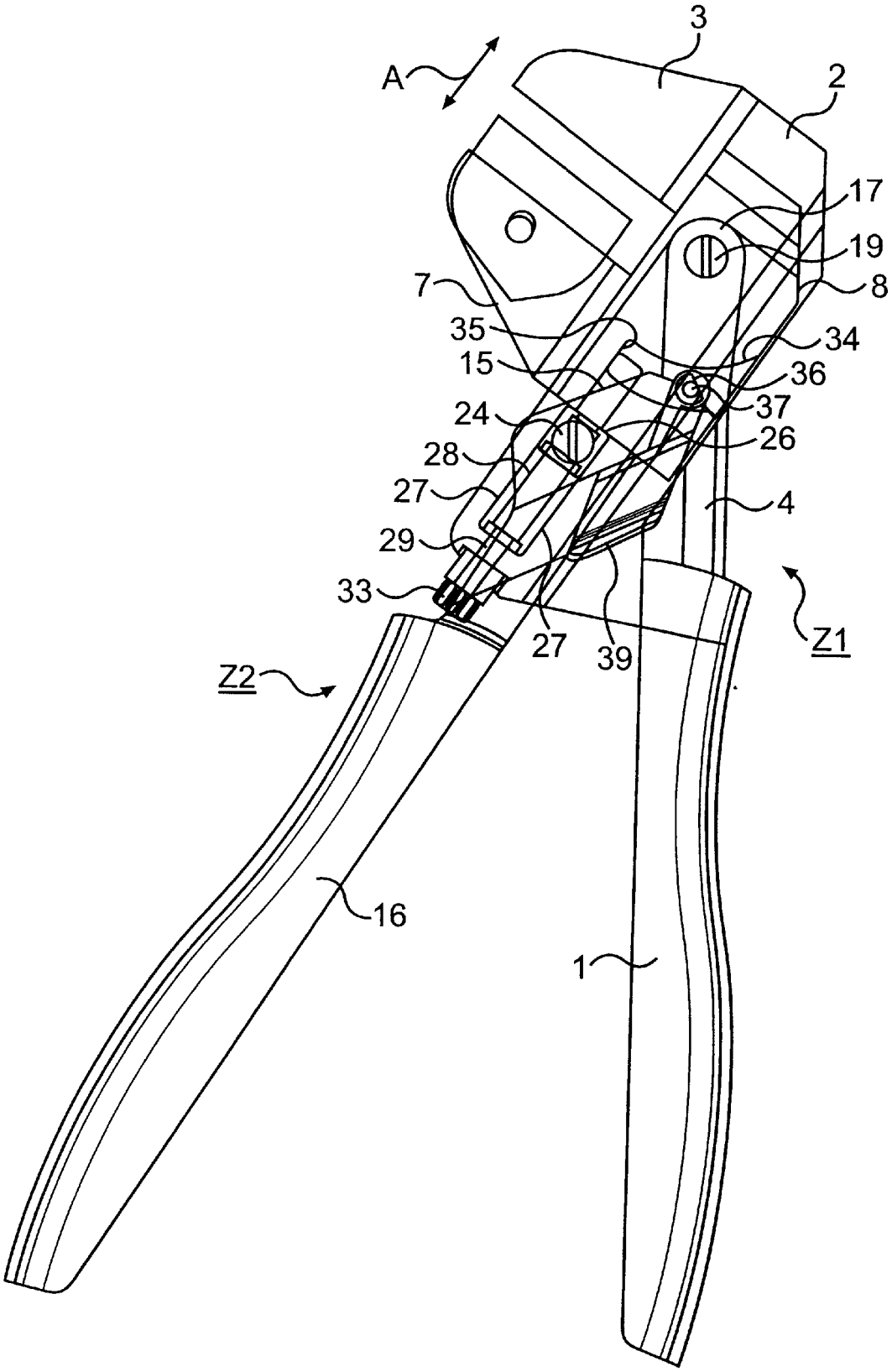
FIG. 5 shows the open pliers in the second rest position.
Figure 6:
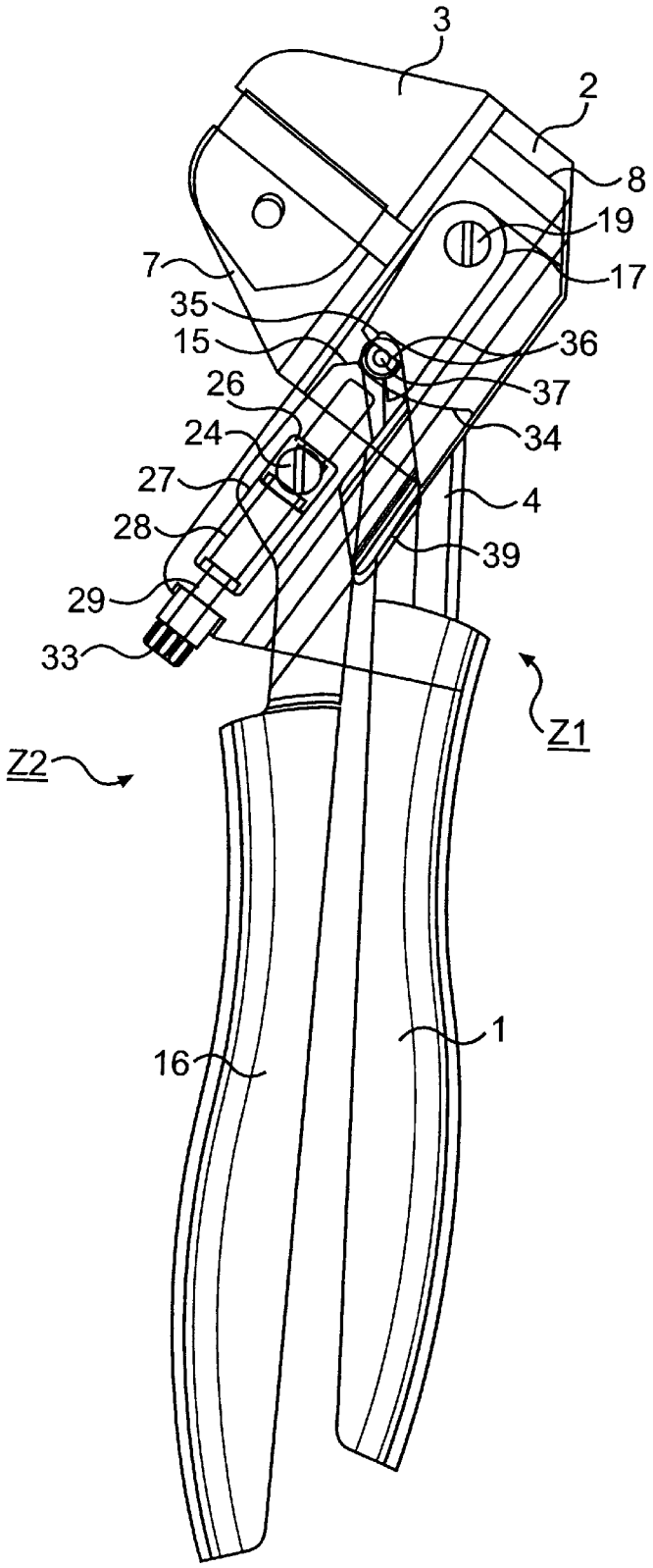
FIG. 6 shows the closed pliers in the second rest position.
Figure 7:
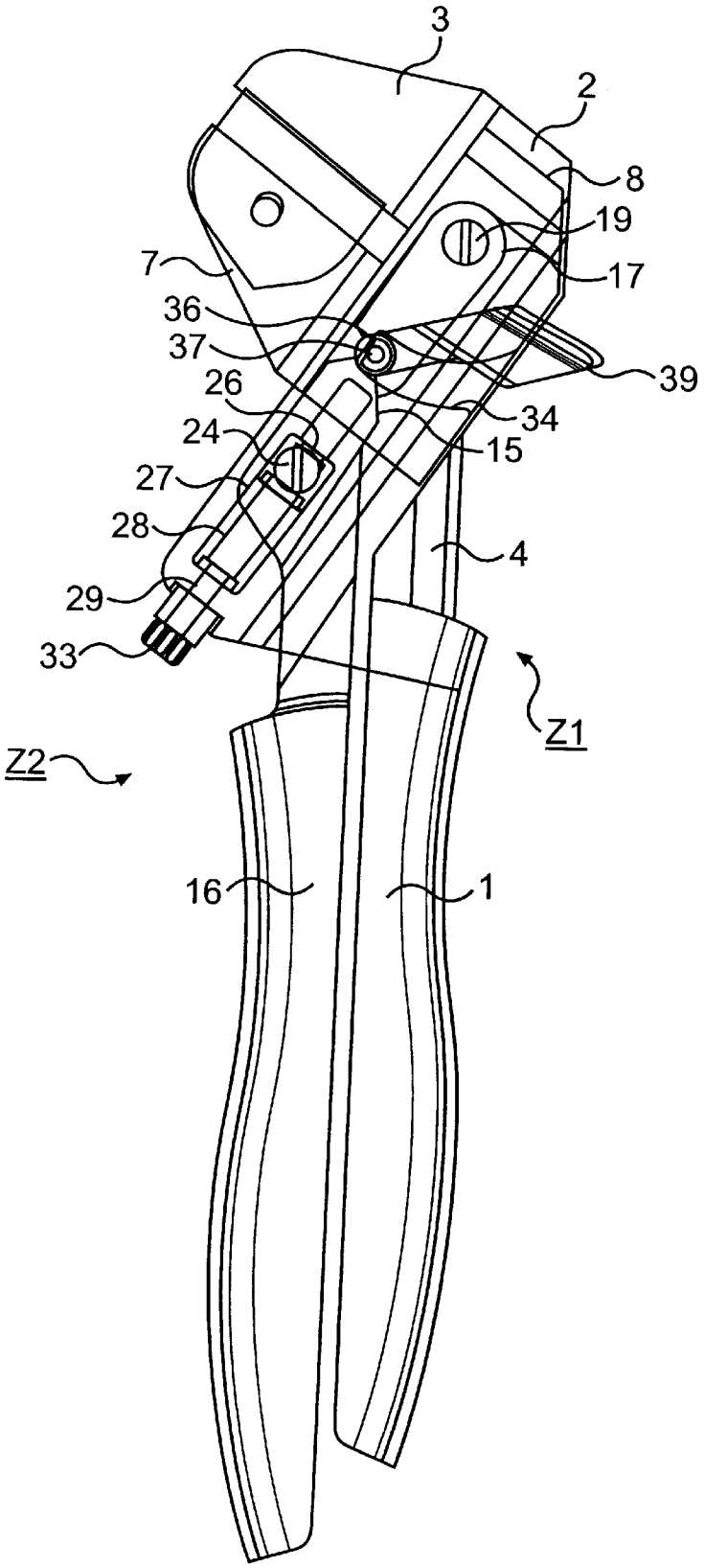
FIG. 7 shows the closed pliers in the second rest position with the eccentric rotated.

FIGS. 5 to 7 show the same movement sequences of the pliers according to FIGS. 1, 3 and 4, although in this case the second plier unit Z2 is displaced relative to the first plier unit Z1 in the operating direction A. As has already been mentioned, the operating direction A runs in the movement direction of the operating jaws 3 and 7 and parallel to the longitudinal slit 27 in the guide rail 2. The movement sequences themselves will not be explained again, so it is only details of the displacement of the relative position between the plier units Z1 and Z2 which will be given hereinbelow.

If the pliers are located in the closed position shown in FIG. 6, then the actuating wheel 33 is relatively freely accessible. This actuating wheel 33 is seated fixedly on the rod section 29, which merges into the threaded-rod section 28 in the direction of the plier mouth. If the actuating wheel 33 is rotated from the position in FIG. 4, then the bearing block 26 is displaced on the threaded rod 28 in the direction of the plier mouth since, as a result of the guidance in the longitudinal slit 27, it cannot rotate along as well. Upon displacement of the bearing block 26 within the longitudinal slit 27 in the direction of the first operating jaw 3, first of all the handle 16 is carried along since it is articulated on the bearing block 26 via the screws 24. Also carried along are the first member 15 and the second member 17 of the toggle lever 14, and thus the carriage 8 and, with it, the second operating jaw 7. The entire second plier unit Z2 is thus displaced in the operating direction A relative to the first plier unit Z1 upon rotation of the actuating wheel 33. This makes it possible to set the width of the mouth.

A further difference between FIGS. 6 and 7 is that, in FIG. 7, the self-clamping function of the pliers is engaged by virtue of the actuating lever 39 being pivoted. In this case, the flattened circumferential part of the eccentric disc 36 then strikes against the end wall 35 of the groove 34. In relation to FIG. 6, the flattened circumferential part of the eccentric disc 36 has been rotated through 90°.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Pliers comprising two parallel operating jaws and two handles, the handles being pivotable relative to one another, one of the handles is fixedly connected to a first of the operating jaws in order to form a first plier unit, another of the handles is articulately connected to a second of the operating jaws via a drive device to form a second plier unit, the operating jaws being movable towards and away one another in an operating direction during pivoting of the handles, a rest position for the second plier unit relative to the first plier unit being presentable in the operating direction, a rail being connected to the first operating jaw and a bearing block being provided, and wherein the drive device includes a toggle lever having a first pin and a second pin, the second pin being an articulation pin, the first pin being guided in a longitudinal slit of the rail and being attached to the bearing block, the slit extending in the operating direction, the first pin being guided in the longitudinal slit and being located near to the another handle and being connected to the drive device, the second articulation pin being connected to a carriage which bears the second operating jaw.

2. The pliers according to claim 1, wherein the second operating jaw is seated on the carriage which is displaceable with a sliding action on the rail.

3. The pliers according to claim 2, further comprising actuating means for displacing the pin guided in the longitudinal slit.

4. The pliers according to claim 3, wherein the bearing block has an internal thread, the actuating means includes a threaded rod rotatably mounted in the longitudinal slit and extending in the operating direction, the bearing block being guided on the threaded rod and being secured against rotation in the longitudinal slit.

5. The pliers according to claim 4, further comprising a central articulation pin for the toggle lever which bears an eccentric which is fixedly connected to an actuating lever, the eccentric engages in a lateral groove in the carriage, the lateral groove having a closed end side and the eccentric being guided against the end side of the groove.

6. The pliers according to claim 5, wherein ends of both the carriage and rail have retaining means for releasably fastening further tool parts.

7. The pliers according to claim 6, wherein the tool parts form a riveting device for blind rivets and having a cylindrical clamping arrangement which is retained on the rail and receives a rivet pin in a clamping manner, a supporting arrangement which encloses the clamping arrangement being movable beyond a free end of the clamping arrangement.

8. The pliers according to claim 1, further comprising an actuating device, the pin guided in the longitudinal slit being displaceable by the actuating device.

9. The pliers according to claim 8, wherein the bearing block has an internal thread, the actuating device includes a threaded rod rotatably mounted in the longitudinal slit and extending in the operating direction, the bearing block being guided on the threaded rod and being secured against rotation in the longitudinal slit.

10. The pliers according to claim 9, further comprising a central articulation pin for the toggle lever which bears an eccentric which is fixedly connected to an actuating lever, the eccentric engages in a lateral groove in the carriage, the lateral groove having a closed end side and the eccentric being guided against the end side of the groove.

11. The pliers according to claim 10, wherein ends of both the carriage and rail have retaining means for releasably fastening further tool parts.

12. The pliers according to claim 1, wherein ends of the carriage and rail have retaining means for releasably fastening further tool parts.

13. The pliers according to claim 12, wherein the tool parts form a riveting device for blind rivets and having a cylindrical clamping arrangement which is retained on the rail and receives a rivet pin in a clamping manner, a supporting arrangement which encloses the clamping arrangement being movable beyond a free end of the clamping arrangement.

* * * * *